US007306075B2

(12) United States Patent
Winslow et al.

(10) Patent No.: US 7,306,075 B2
(45) Date of Patent: Dec. 11, 2007

(54) DYNAMIC HINGE FOR LADDER

(75) Inventors: David A. Winslow, Hermitage, PA (US); Joseph C. Dangrow, Fredonia, PA (US)

(73) Assignee: Werner Co., Greenville, PA (US)

( * ) Notice: Subject to any disclaimer, the term of this patent is extended or adjusted under 35 U.S.C. 154(b) by 155 days.

(21) Appl. No.: 11/104,584

(22) Filed: Apr. 13, 2005

(65) Prior Publication Data

US 2005/0178617 A1 Aug. 18, 2005

Related U.S. Application Data

(63) Continuation of application No. 10/946,642, filed on Sep. 22, 2004, now abandoned.

(60) Provisional application No. 60/504,438, filed on Sep. 22, 2003.

(51) Int. Cl.
*E06C 1/00* (2006.01)

(52) U.S. Cl. ..... 182/163; 16/357

(58) Field of Classification Search ..... 182/163, 182/23, 24, 25; 16/357
See application file for complete search history.

(56) References Cited

U.S. PATENT DOCUMENTS

| | | | | | |
|---|---|---|---|---|---|
| 139,004 | A * | 5/1873 | Hardenbrook et al. | ..... | 182/24 |
| 306,974 | A * | 10/1884 | Stowe | ..... | 182/24 |
| 1,102,682 | A * | 7/1914 | Ping | ..... | 182/25 |
| 1,587,383 | A * | 6/1926 | Kennett | ..... | 182/24 |
| 2,834,528 | A | 5/1958 | Couse | | |
| 3,065,498 | A * | 11/1962 | Johnson | ..... | 16/359 |
| 3,811,151 | A | 5/1974 | Kuemmerlin | | |
| 4,566,150 | A * | 1/1986 | Boothe | ..... | 16/332 |
| 4,787,476 | A * | 11/1988 | Lee | ..... | 182/116 |
| 4,821,843 | A * | 4/1989 | Planchon | ..... | 182/178.2 |
| 5,956,810 | A * | 9/1999 | Spaeth | ..... | 16/358 |
| 6,292,981 | B1 * | 9/2001 | Ford et al. | ..... | 16/357 |
| 6,945,621 | B2 * | 9/2005 | Shin | ..... | 312/405 |
| 2003/0217888 | A1 | 11/2003 | Simpson et al. | | |

* cited by examiner

*Primary Examiner*—Alvin Chin-Shue
(74) *Attorney, Agent, or Firm*—McDermott Will & Emery LLP

(57) ABSTRACT

A dynamic hinge includes a first member connected to a first ladder portion of a ladder, and a second member connected to a second ladder portion. The first member pivots relative to the second member about a pivot axis that does not intersect both the first and second members. The first member includes first and second parallel segments, and the second member includes a third and fourth parallel segments. A guide plate is attached to either the first or second member, and the guide plate is positioned between the first and second segments and between the third and fourth segments. The guide plate includes two non-linear slots, and an other of the first and second members includes two pins, respectively adapted to slide within the two non-linear slots. The pins extend between either the first and second segments or the third and fourth segments.

2 Claims, 8 Drawing Sheets

DYNAMIC HINGE FOR LADDER

CROSS REFERENCE TO RELATED APPLICATIONS

This application is a Continuation of U.S. patent application Ser. No. 10/946,642 filed Sep. 22, 2004 now abandoned which claims the benefit of U.S. Provisional Application No. 60/504,438, filed on Sep. 22, 2003, incorporated herein by reference in their entirety.

TECHNICAL FIELD

The disclosure relates generally to ladders and/or scaffold supports.

BACKGROUND ART

There are many types of ladders in existence today. For example, straight ladders include left and right ladder rails having spaced apart rungs or steps disposed in spaced relation there between. Extension ladders include two or more straight ladder sections slidably mounted relative to one another so as to permit extension of the ladder. Convertible ladders, on the other hand, permit two or more ladder sections (e.g., straight ladder sections or extension ladder sections) to be pivoted relative to one another or otherwise moved in a direction other than along a major ladder axis by means of a hinge or hinges to permit positioning and locking of the ladder in more than one position. Conventional hinges, however, do not have sufficient flexibility to provide various types or ranges of motion between the ladder sections or portions. There is, therefore, a need for an improved hinge between ladder portions.

SUMMARY OF THE DISCLOSURE

This and other needs are met by the present invention, which in accord with one aspect includes a dynamic hinge. The dynamic hinge connects a first ladder portion to a second ladder portion, or portions thereof, to form a convertible ladder or to join other elongated beam members to form a scaffold support. The dynamic hinge includes a first member connected to the first ladder portion and a second member connected to the second ladder portion. The first member pivots relative to the second member about a pivot axis, and the pivot axis does not intersect both the first member and the second member. The first member includes first and second parallel segments, and the second member includes third and fourth parallel segments.

In another aspect, a guide plate is attached to either the first or second member, and the guide plate is positioned between the first segment and the second segment and between the third segment and the fourth segment. The guide plate includes two non-linear slots, and the other of the first member and the second member includes two pins, respectively adapted to slide within the at least two non-linear slots. The pins extend between either the first and second segments or the third and fourth segments.

Other aspects and advantages of the present disclosure will become apparent to those skilled in this art from the following description of preferred aspects taken in conjunction with the accompanying drawings. As will be realized, the disclosed concepts are capable of other and different embodiments, and its details are capable of modifications in various obvious respects, all without departing from the spirit thereof. Accordingly, the drawings, disclosed aspects, and description are to be regarded as illustrative in nature, and not as restrictive.

BRIEF DESCRIPTION OF THE DRAWINGS

The foregoing and other features, aspects and advantages of the present concepts are described in the following detailed description which examples are supplemented by the accompanying drawings, in which.

DETAILED DESCRIPTION OF THE PREFERRED EMBODIMENTS

Figure 1A:
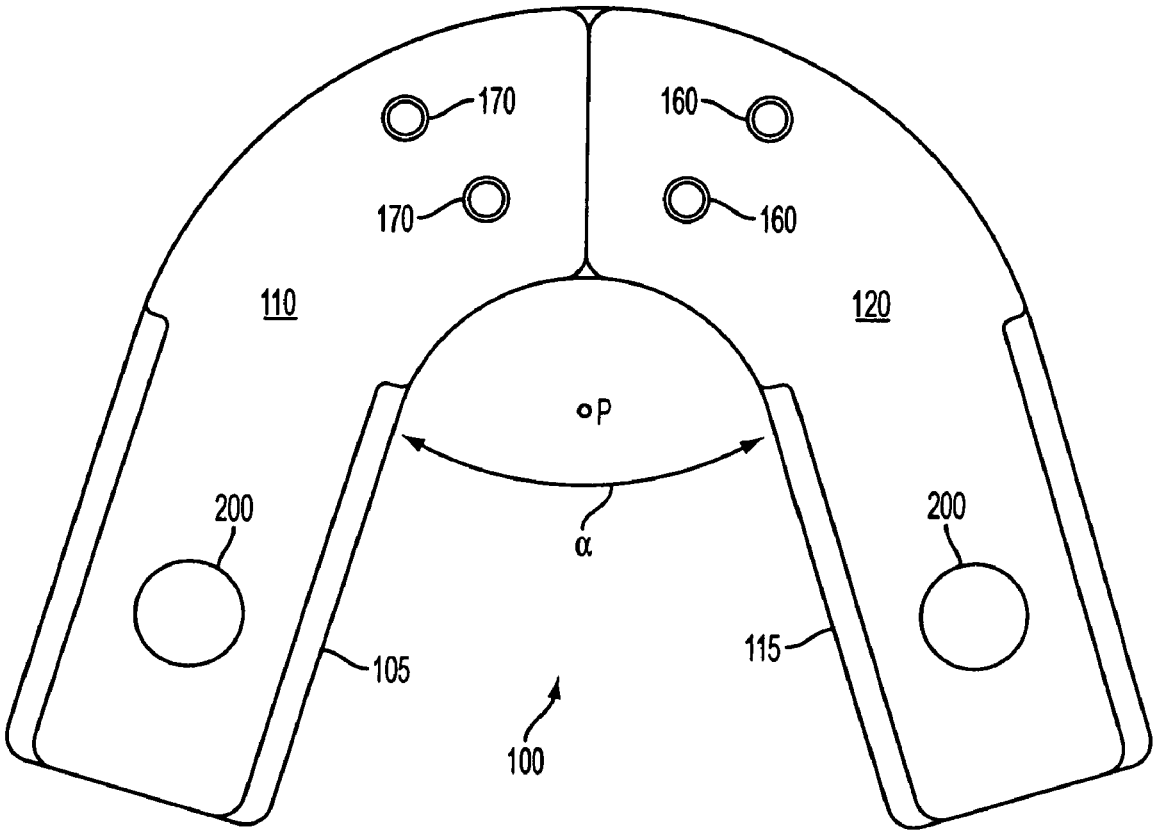
FIGS. 1(*a*)-1(*b*) are, respectively, a side view and an isometric view of a dynamic hinge in a closed position in accord with the present concepts.
Figure 1B:
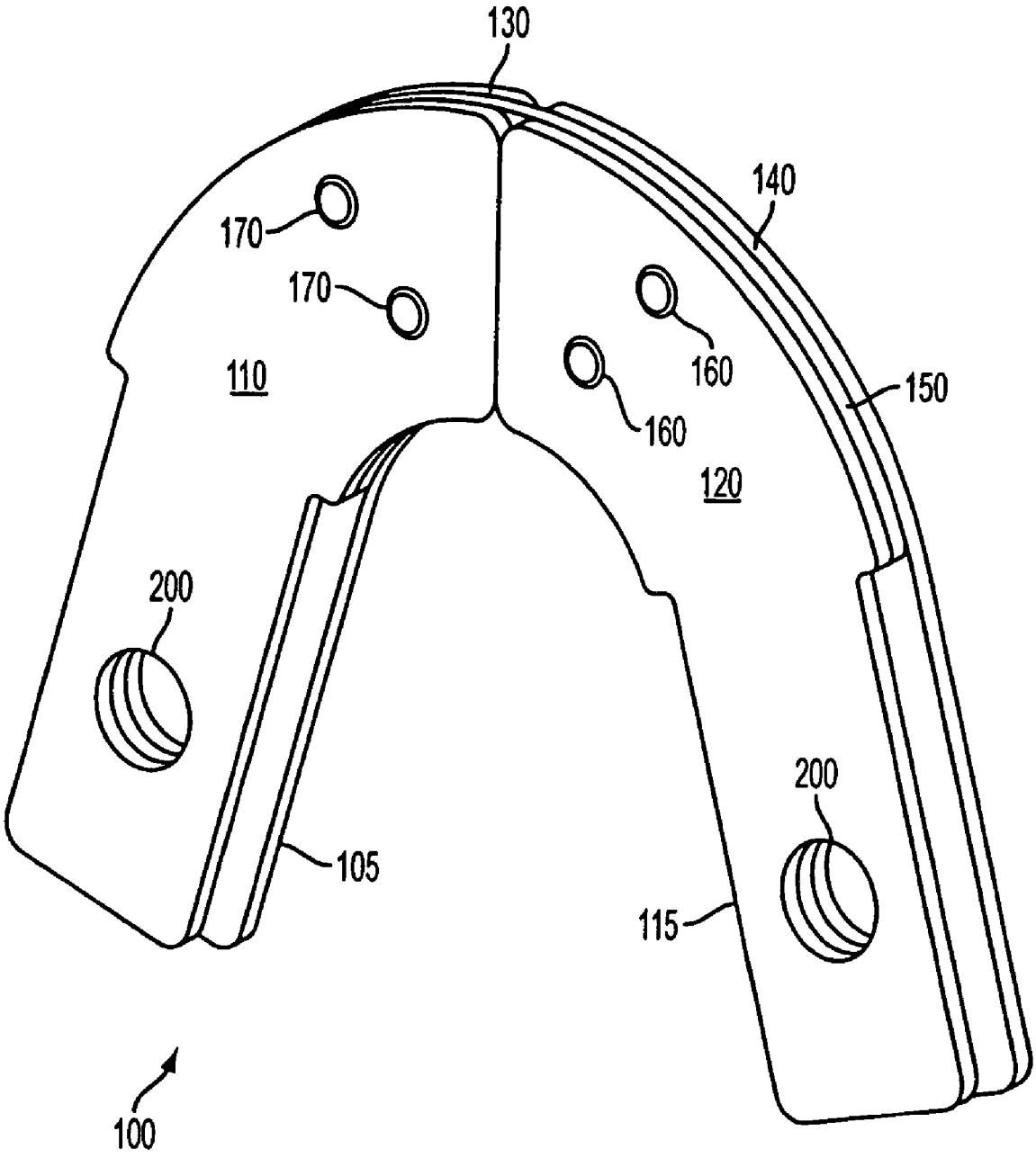

A dynamic hinge 100 for a ladder is depicted by way of example in FIGS. 1(*a*)-1(*b*) and 2(*a*)-2(*b*). The dynamic hinge 100 may be incorporated into a convertible ladder or advantageously used to join separate straight or extension ladder segments to form a convertible ladder. The dynamic hinge 100 may also be incorporated into a scaffold stand, whereupon an elongated beam member, such as but not limited to a ladder side rail, is attached to each end of the dynamic hinge 100 and one or more surfaces are provided between the elongated beam members to support scaffolding. These aspects are further described below.

In the illustrated example, a dynamic hinge 100 in accord with the present concepts includes a first member 105 and a second member 115. Although not required, in one aspect of the dynamic hinge 100, the first member 105 pivots relative to the second member 115 about a pivot axis P that does not intersect with both the first member 105 and the second member 115. The first member 105 may include first and second parallel segments 110, 130, and the second member 115 may include third and fourth parallel segments 120, 140. A guide plate 150 may be fixed to either the first member 105 or the second member 115. As shown, the third segment 120 and the fourth segment 140 are fixed to the guide plate 150 by conventional fastening means 160, such as rivets, screws, or welding. Alternatively, the third segment 120, the fourth segment 140, and the guide plate 150 may be formed as a single element, or two of the aforementioned elements may be formed as a single element.

Figure 2A:
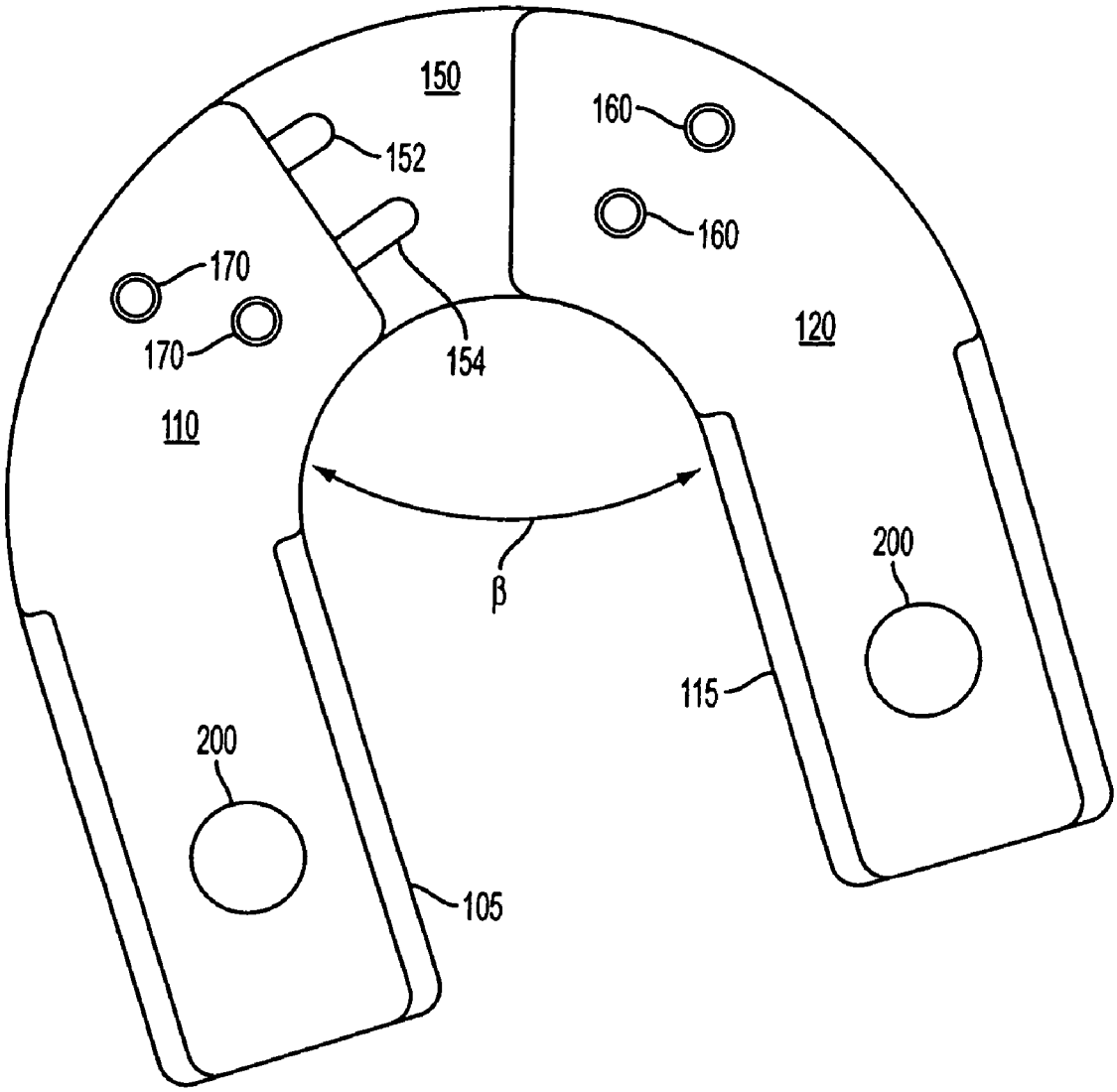
FIGS. 2(*a*)-2(*b*) are, respectively, a side view and an isometric view of the dynamic hinge in an open position.
Figure 2B:
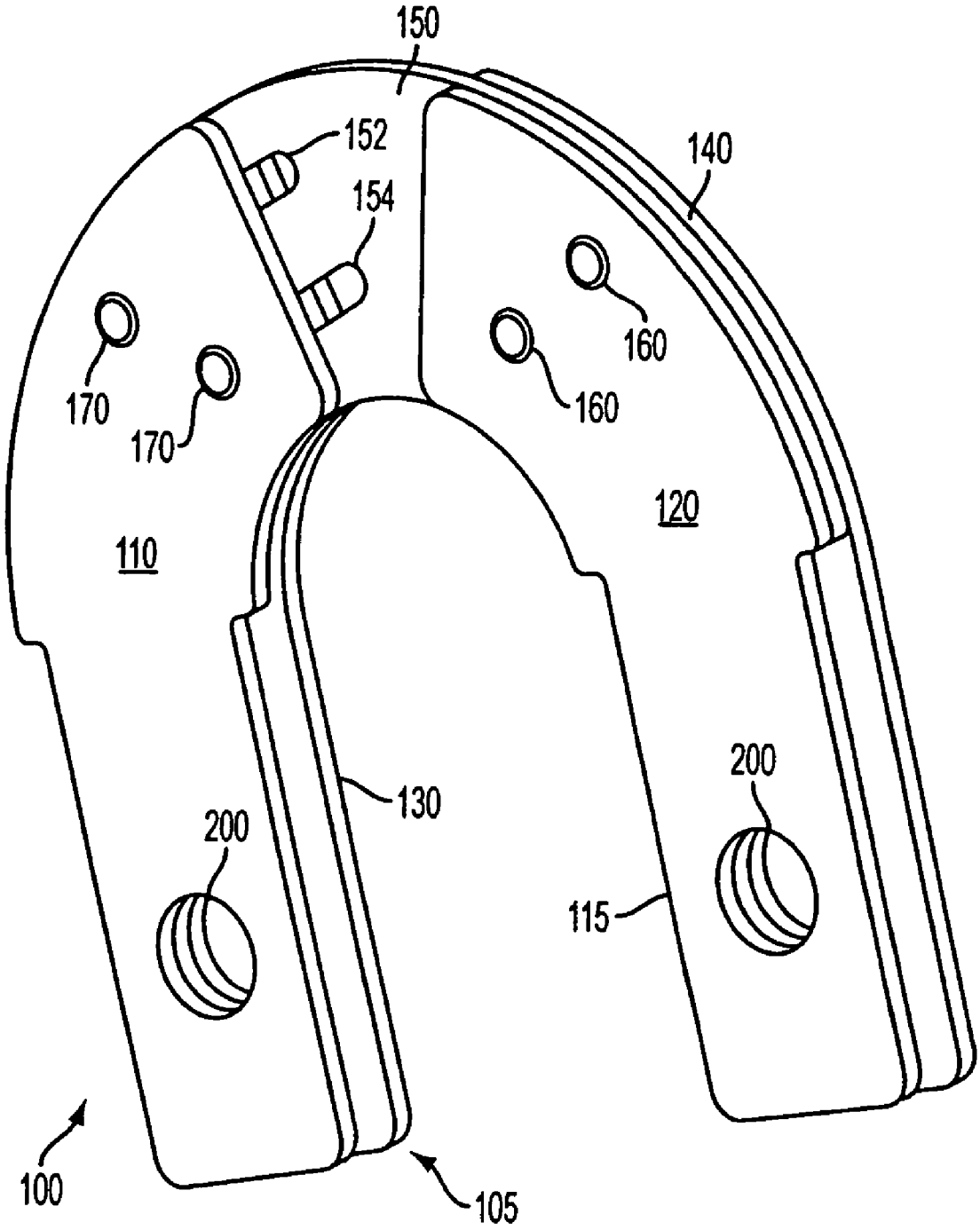

Either the first member 105 or the second member 115 includes at least two non-linear slots 152, 154, and the other of the first member 105 and the second member 115 includes at least two pins or shafts 170 that slide within the slots 152, 154. Although not limited in this manner, the slots 152, 154 are formed in the guide plate 150. The combination of the slots 152, 154 and pins 170 permit the first and second members 105, 115 to move relative to one another along the slots 152, 154 between at least a closed position (i.e., FIG. 1) and an open position (i.e., FIG. 2).

Conventional locking devices may also be provided to fix the first and second members 105, 115 along one or more positions between the open and closed positions. The lock devices include, but are not limited to, a threaded portion on a shaft 170 that protrudes from an outer surface of one of the first and second members 170 and permits attachment of a threaded fastener such as a screw.

Figure 3A:
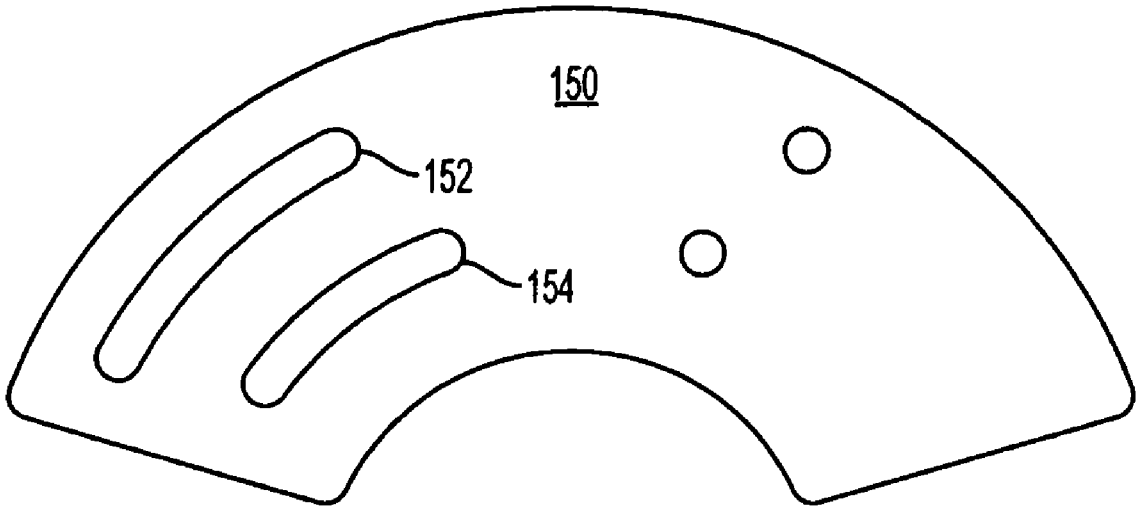
FIGS. 3(*a*)-3(*b*) are side views of alternative center plates for the dynamic hinge.
Figure 3B:
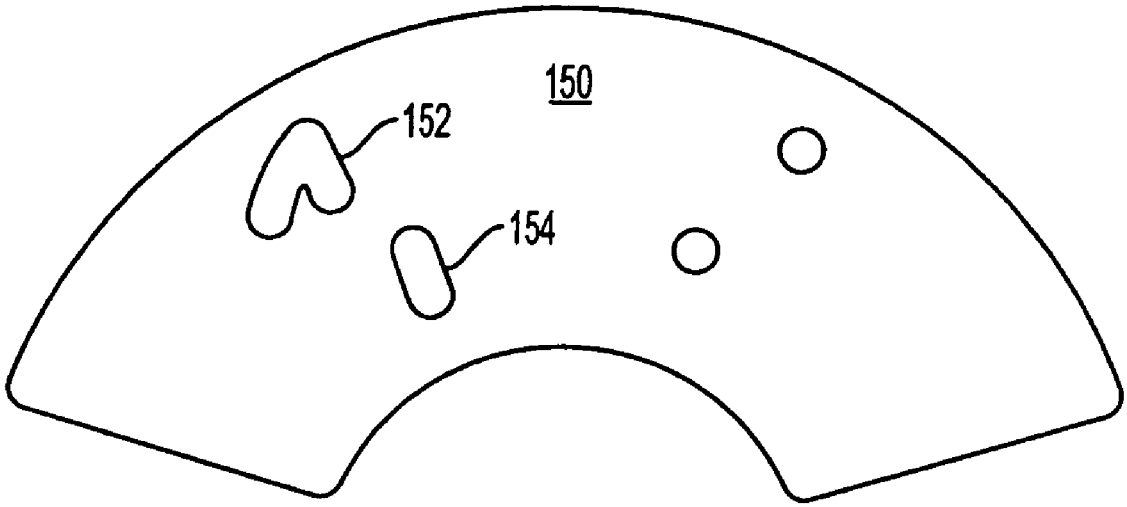

The slots 152, 154 are non-linear, as shown in FIG. 3(*a*), but may comprise a plurality of straight segments. The slots 152, 154 may also assume other curvilinear/arcuate shapes, branches, notches, and/or cutouts permitting other combinations of vertical and horizontal displacements and/or angles between the first member 105 relative to the second member 115, an example of which is shown in FIG. 3(*b*). In the illustrated example, FIG. 1(*a*) shows a closed position providing a first angle a between the first hinge member 105 and the second hinge member 115 (and any elongated ladder members attached thereto), whereas FIG. 2(*a*) shows an open position providing a second angle β between the first hinge member 105 and the second hinge member 115 (and any elongated ladder members attached thereto).

Figure 4:
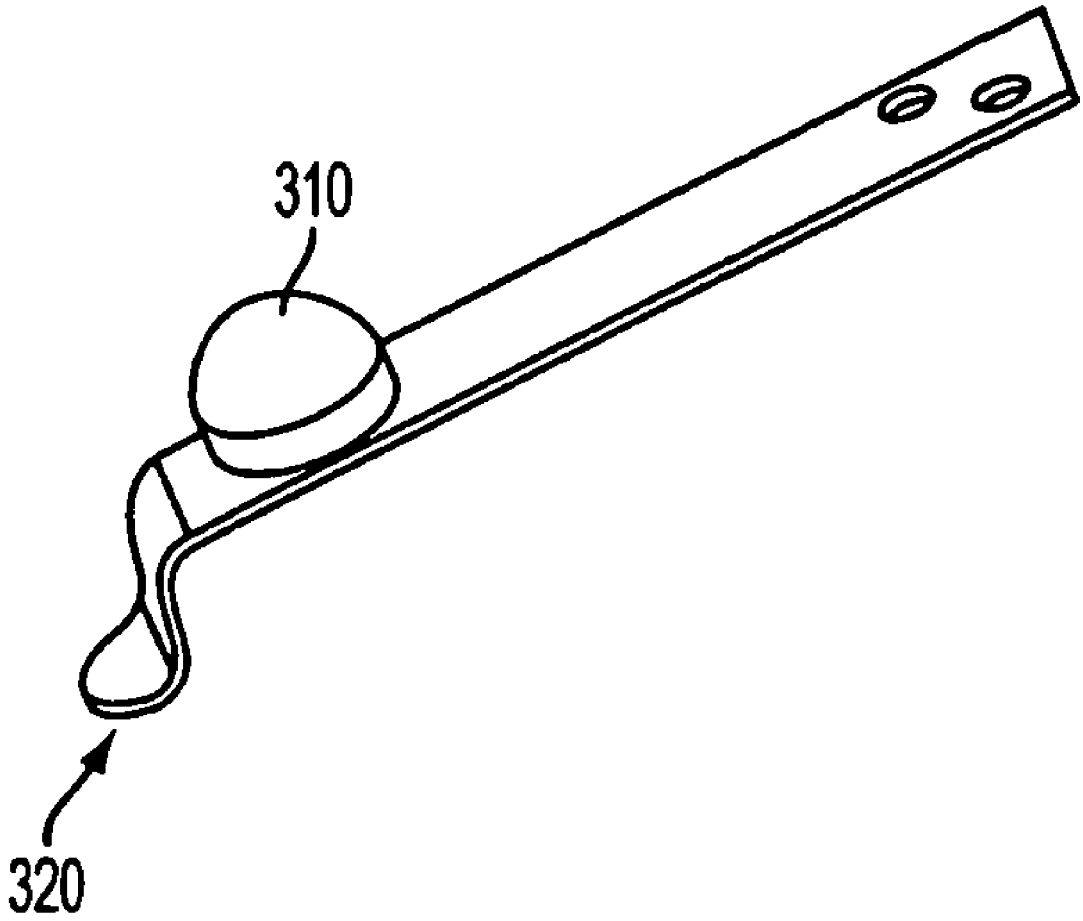
FIG. 4 is an isometric view of the locking tab for the dynamic hinge.

Bottom portions of the first and second members 105, 115 include, in the illustrated example, a locking element 200. The locking element 200 permits elongated portions of the ladder, such as but not limited to the side rails of a ladder, to be releasably attached to the dynamic hinge 100. In one aspect, the locking element 200 comprises a though-hole into which a pin or locking tab 310 (see, e.g., FIG. 4) may be removably inserted. The locking tab 310 may be affixed to a piece of spring steel, for example, which is attached to the exterior of the first, second, third, and fourth segments 110-140 by conventional mechanical attachment device such as, but not limited to, screws, rivets, or welding so that the locking tab 310 is resiliently biased into engagement with the locking elements 200. The locking tab 310 may be disengaged from the locking elements 200 by outward manipulation of the release member 320. Alternatively, the locking tab 310 may be associated with the elongated ladder portion 210 (see, e.g., FIG. 5) and may be removably inserted into the locking element 200 from either an inner surface or an outer surface of each of the first, second, third, and fourth segments 110-140.

In one aspect, the elongated ladder portion includes, at an end adapted to be attached to the dynamic hinge 100, a corresponding or mating structure in accord with the locking element 200. For example, if the locking element 200 comprises through-holes in the first, second, third, and fourth segments 110-140, then the elongated beam member could also include through-holes and/or recesses adapted to receive pins and/or locking tabs inserted through the through-holes in the respective first through fourth segments 110-140. Alternatively, the locking element 200 may include any combination of conventional releasable attachment devices such as, but not limited to, male/female mating components, ratchet/pawl mechanisms, spring-loaded devices, and the like attached to, formed in, and/or integrated with the respective first through fourth segments 110-140 and elongated ladder members.

A top portion of both the first segment 110 and the second segment 130 may be separated by the guide plate 150. The bottom portion of the first segment 110 and the second segment 130 may also be separated by a gap, as shown, which may be equal to that of the width of the guide plate 150 when the first segment 110 and the second segment 130 are planar. The gap may also be greater or lesser in dimension than that of the width of the guide plate 150 when one or both of the first segment 110 and second segment 130 are non-planar along a bottom portion thereof. In one aspect, the bottoms of the first segment 110 and the second segment 130 are displaced inwardly toward one another so as to eliminate any gap therebetween. A similar relation and variability holds between the third segment 120 and the fourth segment 140.

In one aspect, as noted above, the gap formed between the first segment 110 and the second segment 130 and the third segment 120 and fourth segment 140 facilitate insertion of an elongated ladder member therebetween, such as the side rails of a ladder. The elongated ladder member may, for example, have an open cross-section, such as a U- or C-shaped cross-section, or may have a closed cross-section, such as a rectangular cross-section. In the illustrated aspect, the elongated ladder member is adapted to be inserted within the gap formed between the bottom portions of the first through fourth segments 110-140. Alternatively, the elongated ladder member may be adapted to receive the bottom portions of the first through forth segments 110-140 therein. The elongated beam member may be formed, for example, from a lightweight aluminum material, lightweight metal alloys, steel, fiberglass, resin, or wood.

The elongated members need not comprise ladders or ladder portions. In one aspect, the structure defined by the combination of the elongated members and the dynamic hinge 100 need not have a plurality of rungs or steps, as would be provided in a ladder, but one or more lateral supports adapted to support one end of a scaffold or plank member. Such elongated member may comprise a plurality of spaced-apart holes into which a single lateral support member may be affixed. Entry onto the scaffold may be achieved by using a conventional convertible ladder as the support on the other end of the scaffold or plank member. The elongated beam members may themselves be fixed (i.e., non-extensible) or telescoping or otherwise extensible.

Figure 5:
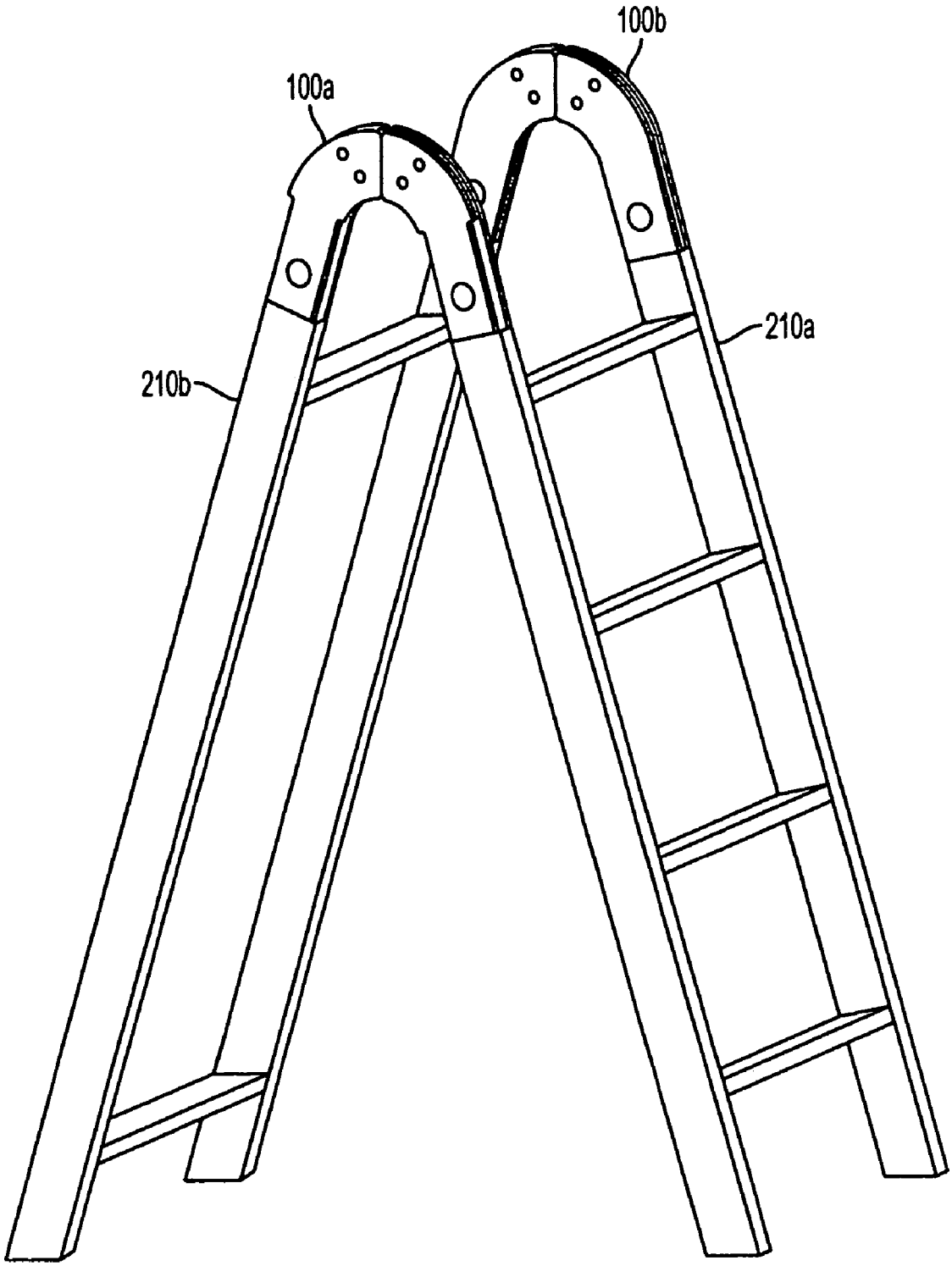
FIG. 5 is a perspective view of a ladder having a pair of dynamic hinges.

In one aspect, as illustrated in FIG. 5, a first dynamic hinge 100*a* and a second dynamic hinge 100*b* are provided to join upper opposing ends of two ladder portions 210*a*, 210*b* to form a convertible ladder. This convertible ladder may be used as a scaffold support member by inserting one end of a scaffold or plank member across the ladder rungs at a predetermined height and by inserting the other end of the scaffold or plank member across another scaffold support member at a substantially similar height.

The embodiments described herein can be practiced by employing conventional materials, methodology and equipment. Accordingly, the details of such materials, equipment and methodology are not set forth herein in detail. In the previous descriptions, numerous specific details of one preferred example, such as specific materials, structures, etc., are set forth to provide a grounding in the present invention. However, it should be recognized that the present invention can be practiced without resorting to the details specifically set forth. In other instances, well known processing structures have not been described in detail, in order not to unnecessarily obscure the present invention. It is to be understood that the present invention is capable of use in various other combinations and environments and is capable of changes or modifications within the scope of the inventive concept as expressed herein.

What is claimed is:

1. A ladder having first and second portions connected by a dynamic hinge, the dynamic hinge comprising:

a first member connected to the first portion; and a second member connected to the second portion, wherein the first member pivots relative to the second member about a pivot axis, the pivot axis not intersecting both the first member and the second member, wherein a guide plate is attached to one of the first and second members, wherein the guide plate includes at least two non-linear slots, an other of the first member and the second member includes at least two pins, respectively adapted to slide within the at least two non-linear slots, the first member includes first and second parallel plates, and second member includes third and fourth parallel plates, and the guide plate is positioned between the first plate and second plate and between the third plate and the fourth plate.

2. The ladder according to claim 1, wherein the pins extend between one of the first and second segments and the third and fourth segments.

* * * * *